US010944188B2

(12) United States Patent
Ono et al.

(10) Patent No.: US 10,944,188 B2
(45) Date of Patent: Mar. 9, 2021

(54) TERMINAL BLOCK

(71) Applicant: OMRON Corporation, Kyoto (JP)

(72) Inventors: Masahiro Ono, Okayama (JP); Masato Matoba, Okayama (JP); Kiyotaka Hashimoto, Okayama (JP); Taijiro Fujiwara, Okayama (JP); Hirokazu Hoshino, Okayama (JP); Masao Nagase, Wake-gun (JP); Masami Nishida, Osaka (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 16/643,583

(22) PCT Filed: Mar. 6, 2019

(86) PCT No.: PCT/JP2019/008728
§ 371 (c)(1),
(2) Date: Mar. 1, 2020

(87) PCT Pub. No.: WO2019/176661
PCT Pub. Date: Sep. 19, 2019

(65) Prior Publication Data

US 2020/0243989 A1 Jul. 30, 2020

(30) Foreign Application Priority Data

Mar. 14, 2018 (JP) ..... JP2018-047286
Feb. 28, 2019 (JP) ..... JP2019-036882

(51) Int. Cl.
*H01R 9/24* (2006.01)
*H01R 12/51* (2011.01)
(Continued)

(52) U.S. Cl.
CPC ..... *H01R 9/2416* (2013.01); *H01R 4/4809* (2013.01); *H01R 9/2425* (2013.01); *H01R 12/515* (2013.01); *H01R 12/7005* (2013.01)

(58) Field of Classification Search
CPC ..... H01R 12/515; H01R 12/7005; H01R 9/2416; H01R 9/2425; H01R 4/4809
See application file for complete search history.

(56) References Cited

U.S. PATENT DOCUMENTS 6,796,830 B2 * 9/2004 Suss ..... H01R 4/2466 439/395
7,845,970 B2 * 12/2010 Stromiedel ..... H01R 12/58 439/441
(Continued)

FOREIGN PATENT DOCUMENTS

CN 2909560 Y 6/2007
CN 107093807 A 8/2017
(Continued)

OTHER PUBLICATIONS

An English translation of the International Search Report("ISR") of PCT/JP2019/008728 dated May 28, 2019.
(Continued)

*Primary Examiner* — Briggitte R. Hammond
(74) *Attorney, Agent, or Firm* — Metrolex IP Law Group, PLLC

(57) ABSTRACT

A terminal block includes a display-use moveable member which has a main body portion that can reciprocate in the direction intersecting a terminal connection surface and a contact moveable portion that extends along a guide surface, has a first end portion in an extension direction that is disposed so as to come into contact with a conductor portion in an electric wire passage portion and move in a first direction away from the terminal connection surface, and has a second end portion in the extension direction that is
(Continued)

connected to the main body portion, and moves in an array direction in response to movement of the first end portion in the first direction to move the main body portion in a second direction toward the terminal connection surface.

7 Claims, 9 Drawing Sheets

(51) Int. Cl.
*H01R 4/48* (2006.01)
*H01R 12/70* (2011.01)

(56) References Cited

U.S. PATENT DOCUMENTS

| | | | | |
|---|---|---|---|---|
| 9,397,444 | B1 * | 7/2016 | Wu | H01R 4/4836 |
| 9,819,121 | B2 * | 11/2017 | Masaki | H01R 4/4827 |
| 10,074,917 | B1 * | 9/2018 | Ono | H01R 9/2425 |
| 2018/0248282 | A1 | 8/2018 | Ono et al. | |

FOREIGN PATENT DOCUMENTS

| | | | |
|---|---|---|---|
| CN | 206401537 | U | 8/2017 |
| JP | 3098937 | U | 3/2004 |
| JP | 2004-200091 | A | 7/2004 |
| JP | 2007-026991 | A | 2/2007 |
| JP | 2009-230859 | A | 10/2009 |
| JP | 2018-142527 | A | 9/2018 |

OTHER PUBLICATIONS

The Written Opinion("WO") of PCT/JP2019/008728 dated May 28, 2019.
The Taiwanese Office Action dated Nov. 13, 2019 in a counterpart Taiwanese patent application.
The Chinese Office Action (CNOA) dated Sep. 24, 2020 in a counterpart Chinese patent application.

* cited by examiner

TERMINAL BLOCK

TECHNICAL FIELD

The present disclosure relates to a terminal block of a push-in connection type.

BACKGROUND ART

Patent document 1 discloses a terminal block including a housing having a terminal connection surface that has a opening portion through which an electric wire can be inserted and pulled out and a confirmation window disposed adjacent to the opening portion, and a holding portion that is provided inside the housing and communicates with the opening portion. In the terminal block, a long display body is provided in the holding portion, the long display body being configured to pivot about a pivot shaft located at an approximately center of the holding portion in a direction intersecting the terminal connection surface when the electric wire is inserted or pulled out. This display body is provided integrally with a display portion provided at one end in a long-side direction and disposed so as to be exposed through the confirmation window when the display body pivots, and a connection status of the electric wire indicated by whether this display portion is exposed through the confirmation window is no to a user.

RELATED ART DOCUMENTS

Patent Documents

Patent document 1: Japanese Examined Utility Model Registration Publication No. 3098937

SUMMARY OF THE INVENTION

Technical Problem

In the terminal block, a distance from the pivot shaft to the display portion of the display body is long, and thus, for example, a reduction in size of the terminal block may prevent a region where the display portion pivots from being sufficiently secured in the holding portion and in turn prevent the accurate connection status of the electric wire from being notified to the user.

It is therefore an object of the present disclosure to provide a terminal block capable of accurately notifying a user of a connection status of an electric wire.

Solution To Problem

A terminal block as an example according to the present disclosure includes:

a housing having insulation properties, the housing having a holding portion provided in the housing and a terminal connection surface, a first opening portion through which a conductor portion of an electric wire can be inserted and pulled out, a second opening portion that is adjacent to the first opening portion and through which a jig can be inserted and pulled out, and a third opening portion that is adjacent to the second opening portion and through which a connection state of the conductor portion can be displayed are arranged in series on the terminal connection surface and each communicate with the holding portion; and a terminal electrode portion, a leaf spring portion, a display-use moveable member, and a return spring portion that are all disposed in the holding portion, in which the holding portion has an electric wire passage portion that extends in a direction intersecting the terminal connection surface, communicates with the first opening portion, and through which the conductor portion of the electric wire can move, a jig passage portion that extends in the direction intersecting the terminal connection surface, communicates with the second opening portion, and through which the jig can move, and a guide surface that extends in an array direction of the first opening portion, the second opening and the third opening portion and is disposed so as to cause the electric wire passage portion and the jig passage portion to be interposed between the guide surface and the terminal connection surface in the direction intersecting the terminal connection surface, the terminal electrode portion has a contact portion that extends along the electric wire passage portion and is disposed so as to come into contact with the conductor portion inserted through the first opening portion into the electric wire passage portion, the leaf spring portion has a fixed portion that is provided at one end portion of the leaf spring portion and is fixed to the housing to cause the electric wire passage portion and the jig passage portion to be located between the fixed portion and the contact portion of the terminal electrode portion in the array direction, and a moveable portion that is provided at the other end of the leaf spring portion and is disposed between the fixed portion and the terminal electrode portion in the array direction, the moveable portion facing the contact portion of the terminal electrode portion, extending over the electric wire passage portion and the jig passage portion, and being moveable relative to the fixed portion, the moveable portion is disposed so as to move relative to the fixed portion to cause the conductor portion inserted through the first opening portion into the electric wire passage portion to be held between the moveable portion and the contact portion of the terminal electrode portion to bring the conductor portion and the terminal electrode portion into a connected state and to come into contact with the jig inserted through the second opening portion into the jig passage portion and move relative to the fixed portion to release the contact between the moveable portion and the conductor portion to bring the conductor portion and the terminal electrode portion into a disconnected state, the display-use moveable member has a main body portion that extends in the direction intersecting the terminal connection surface and can reciprocate between a display position where a distal end portion in an extension direction is exposed outside the housing through the third opening portion and a non-display position where the distal end portion is held in the holding portion, and a contact moveable portion that extends along the guide surface, has a first end portion in an extension direction that is disposed so as to come into contact with the conductor portion in the electric wire passage portion and move in a first direction intersecting the terminal connection surface and away from the terminal connection surface, and has a second end portion in the extension direction that is connected to the main body portion, and moves in the array direction in response to movement of the first end portion in the first direction to move the main body portion in a second direction intersecting the terminal connection surface and toward the terminal connection surface, the return spring portion is configured to push the main body portion of the display-use moveable member in the first direction, when the conductor portion is inserted through the first opening portion into the electric wire passage portion to move the first end portion of the contact moveable portion in the first direction, the main body portion moves in the second direction, and the distal end portion of the main body portion adjacent to the terminal connection surface moves from the non-display position to the display position to display a state where the connection state of the conductor portion with respect to the terminal electrode portion is changed from the disconnected state to the connected state, and when the conductor portion is pulled out from the electric wire passage portion to move the main body portion in the first direction by pushing force of the return spring portion, the distal end portion moves from the display position to the non-display position to display a state where the connection state of the conductor portion with respect to the terminal electrode portion is changed from the connected state to the disconnected state.

Advantageous Effects of Invention

According to the terminal block, when the conductor portion of the electric wire is inserted through the first opening portion into the electric wire passage portion to move the first end portion of the contact moveable portion in the first direction, the display-use moveable member displays a state where the distal end portion of the main body portion is exposed outside the housing from the holding portion through the third opening portion, and the connection state of the conductor portion with respect to the terminal electrode portion is changed from the disconnected state to the connected state. Further, when the conductor portion the electric wire is pulled out from the electric wire passage portion, the display-use moveable member displays a state where the main body portion moves in the first direction by the pushing force of the return spring portion, the distal end portion exposed outside the housing through the third opening portion is held in the holding portion, and the connection state of the conductor portion with respect to the terminal electrode portion is changed from the connected state to the disconnected state. That is, since the terminal block is capable of displaying whether the connection state of the conductor portion with respect to the terminal electrode portion is the connected state or the disconnected state through the third opening portion by not a rotary motion but a linear motion of the distal end portion of the display-use moveable member in the direction intersecting the terminal connection surface, even when the terminal block is reduced in size, a region where the display-use moveable member can move can be secured in the holding portion. As a result, even when the terminal block is reduced in size, the user can be notified of the accurate connection status of the electric wire.

DESCRIPTION OF EMBODIMENTS

Hereinafter, a description will be given of an example of the present disclosure with reference to the accompanying drawings. Note that, in the following description, terms representing specific directions or positions (for example, terms including "up", "down", "right", and "left") will be used as necessary, but the use of these terms is intended to facilitate understanding of the present disclosure with reference to the drawings, and the technical scope of the present disclosure is not limited by the meanings of the terms. Further, the following description shows merely an example in nature and is not intended to limit the present disclosure, applications of the present disclosure, or uses of the present disclosure. Furthermore, the drawings are schematic drawings, and ratios between dimensions are not necessarily equal to the actual ratios.

First Embodiment

Figure 1:
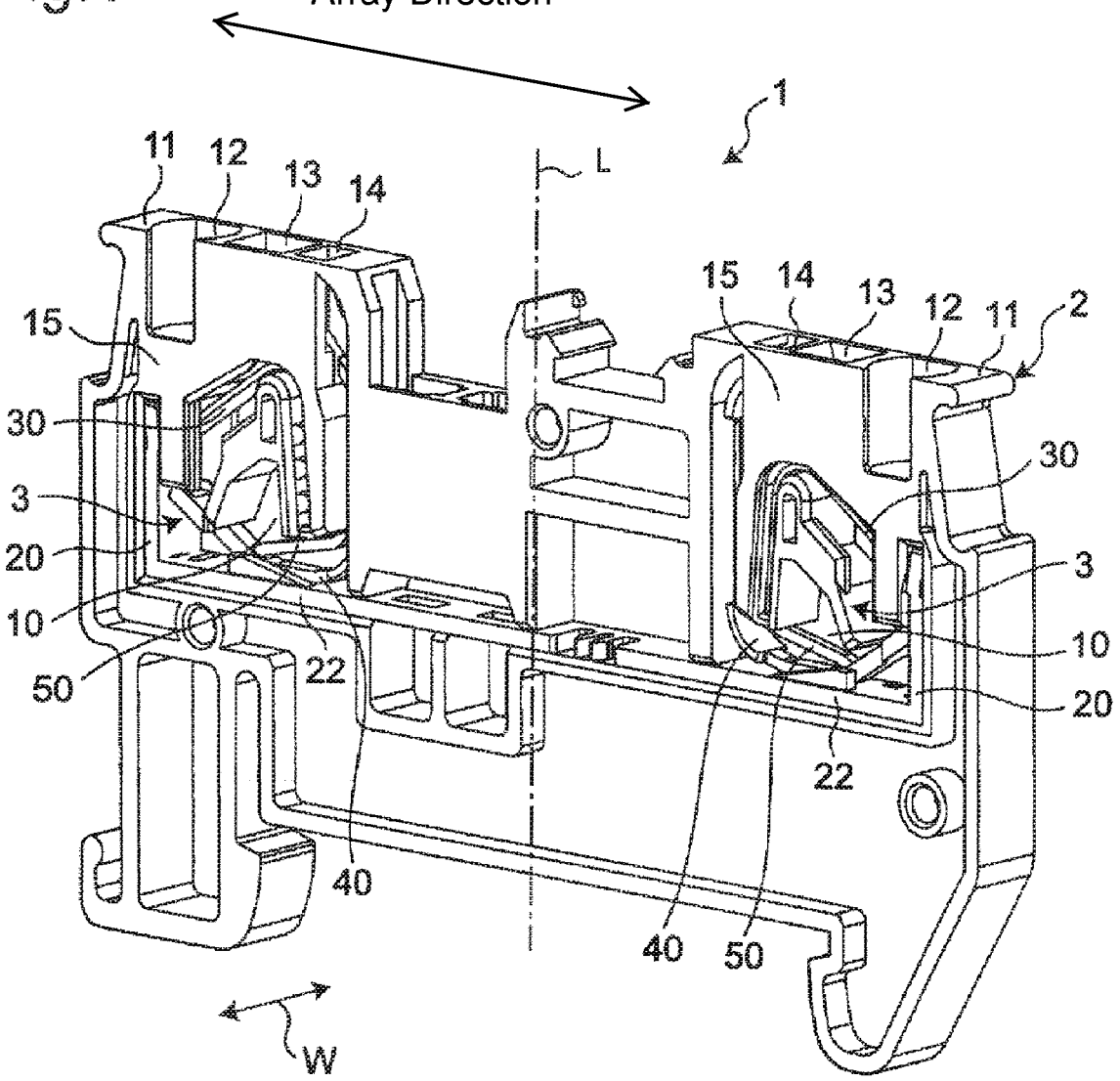
FIG. 1 is a perspective view showing a terminal block according to a first embodiment of the present disclosure.

As shown In FIG. 1, a terminal block 1 according to a first embodiment of the present disclosure includes a housing 2 having insulation properties and a terminal connection portion 3 provided inside the housing 2. The terminal block 1 is provided with two terminal connection portions 3 as an example. Each of the terminal connection portions 3 has a terminal electrode portion 20, a leaf spring portion 30, a display-use moveable member 40, and a return spring portion 50.

As shown in FIG. 1, the housing 2 has two holding portions 10 each having a hollow, approximately rectangular plate shape and having a corresponding one of the terminal connection portions 3 held therein, and a terminal connection surface 11.

The holding portions 10 are provided inside the housing 2 and are arranged approximately symmetrical to an imaginary straight line L passing through a center, in a long-side direction, of the housing 2.

The terminal connection surface 11 serves as one of side surfaces of the housing 2 extending in the long-side direction. The terminal connection surface 11 is provided with two sets of first opening portions 12, second opening portions 13, and third opening portions 14 arranged in series, and each of the sets of the first opening portions 12, the second opening portions 13, and the third opening portions 14 communicates with a corresponding one of the holding portions 10. The first opening portion 12 is configured such that a conductor portion of an electric wire can be inserted and pulled out through the first opening portion 12, the second opening portion 13 is disposed adjacent to the first opening portion 12 and is configured such that a jig can be inserted and pulled out through the second opening portion 13, and the third opening portion 14 is disposed adjacent to the second opening portion 13 and is configured such that a connection state of the conductor portion can be displayed.

An opening surface 15 having an opening portion is provided on one side in a width direction W intersecting a direction in which the first opening portion 12, the second opening portion 13, and the third opening portion 14 are arranged on a corresponding one of the holding portions 10 (that the long-side direction of the housing 2. Hereinafter, it is simply referred to as an array direction) and a direction intersecting (for example, orthogonal to) the terminal connection surface 11. Through this opening portion, the terminal connection portion 3 (that is, the terminal electrode portion 20, the leaf spring portion 30, the display-use moveable member 40, and the return spring portion 50) is exposed outside of the housing 2.

Each of the holding portions 10 is provided with a guide surface 16 facing the terminal connection surface 11. As an example, the guide surface 16 is provided on a horizontal plate portion 22 of the terminal electrode portion 20 to be described later, extends in the array direction, and is disposed so as to come into contact with the contact moveable portion 42 of the display-use moveable member 40 to be described later.

Figure 2:
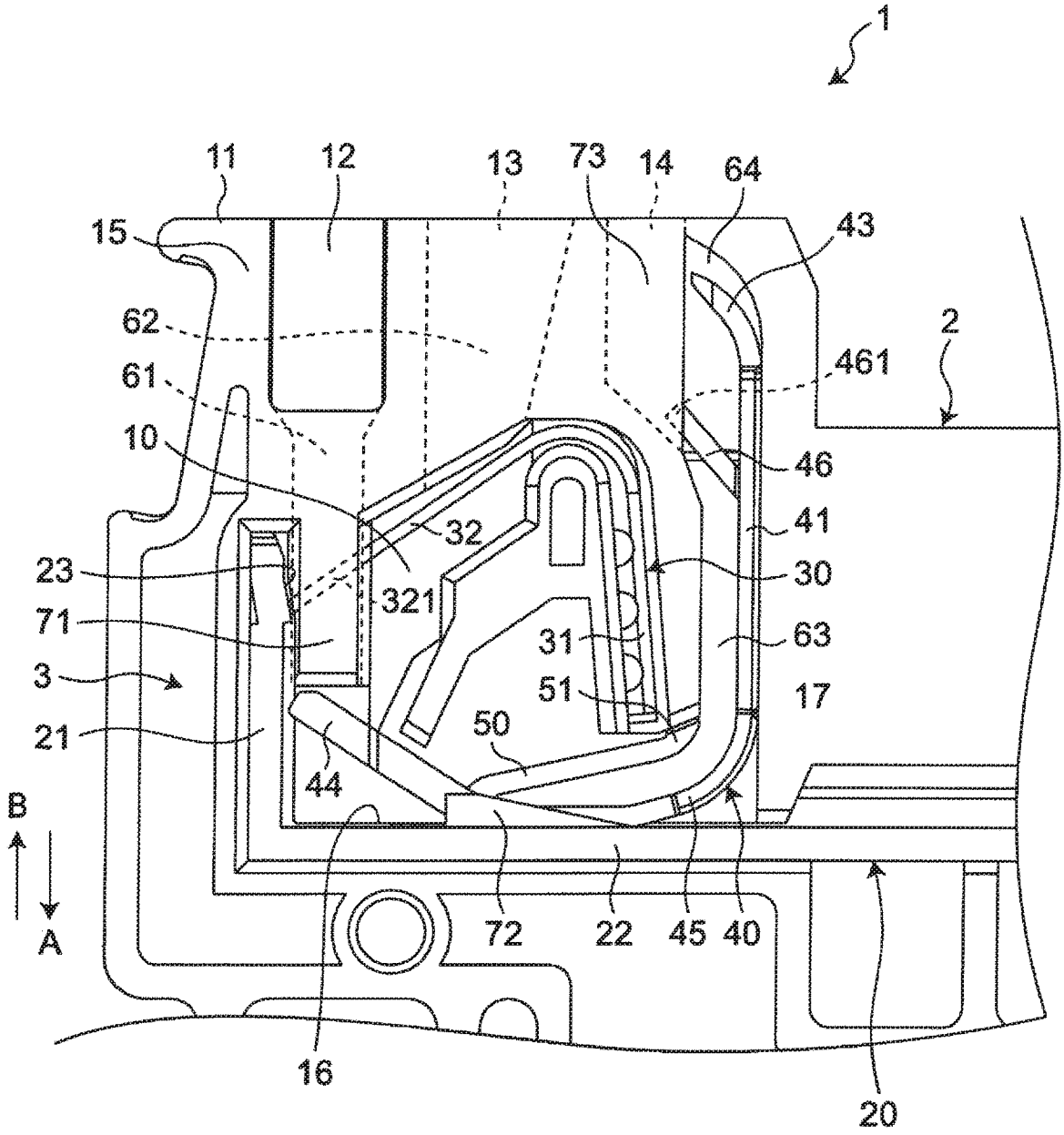
FIG. 2 is an enlarged plan view showing a holding portion and a terminal connection portion of the terminal block shown in FIG. 1.

Further, as shown in FIG. 2, each of the holding portions 10 has an electric wire passage portion 61, a jig passage portion 62, and a moveable member passage portion 63. The electric wire passage portion 61, the jig passage portion 62, and the moveable member passage portion 63 each serves as a part of the housing 2, and are disposed between the terminal connection surface 11 and the guide surface 16 in the direction intersecting the terminal connection surface 11.

The electric wire passage portion 61 extends in the direction intersecting (for example, orthogonal to) the terminal connection surface 11. The electric wire passage portion 61 communicates with the first opening portion 12 to form a passage through which the conductor portion of the electric wire can move. The jig passage portion 62 extends in the direction intersecting (for example, orthogonal to) the terminal connection surface 11. The jig passage portion 62 communicates with the second opening portion 13 to form a passage through which the jig can move.

The moveable member passage portion 63 extends in the direction intersecting (for example, orthogonal to) the terminal connection surface 11. The moveable member passage portion 63 communicates with the third opening portion 14 to form a passage through which a main body portion 41 of the display-use moveable member 40 to be described later can move. The moveable member passage portion 63 is disposed so as to cause the third opening portion 14 to be located between the moveable member passage portion 63 and the second opening portion 13 in the array direction. That is, the moveable member passage portion 63 is disposed so as not to be exposed outside the housing 2 through the third opening portion 14 when viewed from the direction orthogonal to the terminal connection surface 11.

A curved portion 64 is provided at an end of the moveable member passage portion 63 adjacent to the third opening portion 14. The curved portion 64 is curved in the direction intersecting the terminal connection surface 11 and toward the terminal connection surface 11, and in the array direction and toward the second opening portion 13 from the third opening portion 14.

The electric wire passage portion 61 and the jig passage portion 62 are arranged, in the array direction, between the terminal electrode portion 20 and a fixed portion 31 of the leaf spring portion 30 to be described later. The electric wire passage portion 61 is disposed near the terminal electrode portion 20, and the jig passage portion 62 is disposed near the fixed portion 31 of the leaf spring portion 30. Further, the moveable member passage portion 63 is disposed so as to cause the fixed portion 31 of the leaf spring portion 30 to be located between the moveable member passage portion 63 and the jig passage portion 62 in the array direction.

As shown in FIG. 2, the terminal electrode portion 20 extends along the electric wire passage portion 61 and has a contact portion 23 disposed so as to come into contact with the conductor portion inserted through the first opening portion 12 into the holding portion.

Specifically, the terminal electrode portion 20 includes a vertical plate portion 21 having an approximately rectangular plate shape extending in the direction intersecting (for example, orthogonal to) the terminal connection surface 11 and the horizontal plate portion 22 having an approximately rectangular plate shape extending in the array direction. The horizontal plate portion 21 is provided with the contact portion 23 that is disposed adjacent to a side of the electric wire passage portion 61 remote from the jig passage portion 62 in the array direction and on a surface facing a moveable portion 32 of the leaf spring portion 30 to be described later. Further, the horizontal plate portion 22 is connected to an end of the vertical plate portion 21 adjacent to the guide surface 16 and has a surface facing the terminal connection surface 11 serving as the guide surface 16. Note that, as shown in FIG. 1, the horizontal plate portions 22 of the terminal electrode portion 20 disposed in the holding portions 10 are connected to and integrated with each other.

As shown in FIG. 2, the leaf spring portion 30 has a plate shape with an intermediate portion bent and has the fixed portion 31 provided at one end portion in an extension direction and the moveable portion 32 provided at the other end portion in the extension direction.

The fixed portion 31 is fixed to the housing 2 such that the electric wire passage portion 61 and the jig passage portion 62 are located between the fixed portion 31 and the vertical plate portion 21 of the terminal electrode portion 20 in the array direction. Specifically, the fixed portion 31 is fixed to a leaf spring fixing portion 17 of the housing 2 disposed between the jig passage portion 62 and the moveable member passage portion 63 in the array direction and between the terminal connection surface 11 and the guide surface 16 in the direction orthogonal to the terminal connection surface 11.

The moveable portion 32 is disposed between the fixed portion 31 and the terminal electrode portion 20 in the array direction and near the terminal electrode portion 20. That is, the moveable portion 32 is disposed near the vertical plate portion 21 of the terminal electrode portion 20, facing the contact portion 23 of the vertical plate portion 21, and extending over the electric wire passage portion 61 and the jig passage portion 62. Further, the moveable portion 32 is resiliently deformable and moveable toward the fixed portion 31.

As shown in FIG. 2, the display-use moveable member 40 has a slender plate shape with an intermediate portion bent and has the main body portion 41 and the contact moveable portion 42 extending along the guide surface 16 and connected to the main body portion 41. The display-use moveable member 40 is made of, for example, an insulating resin.

Figure 3:
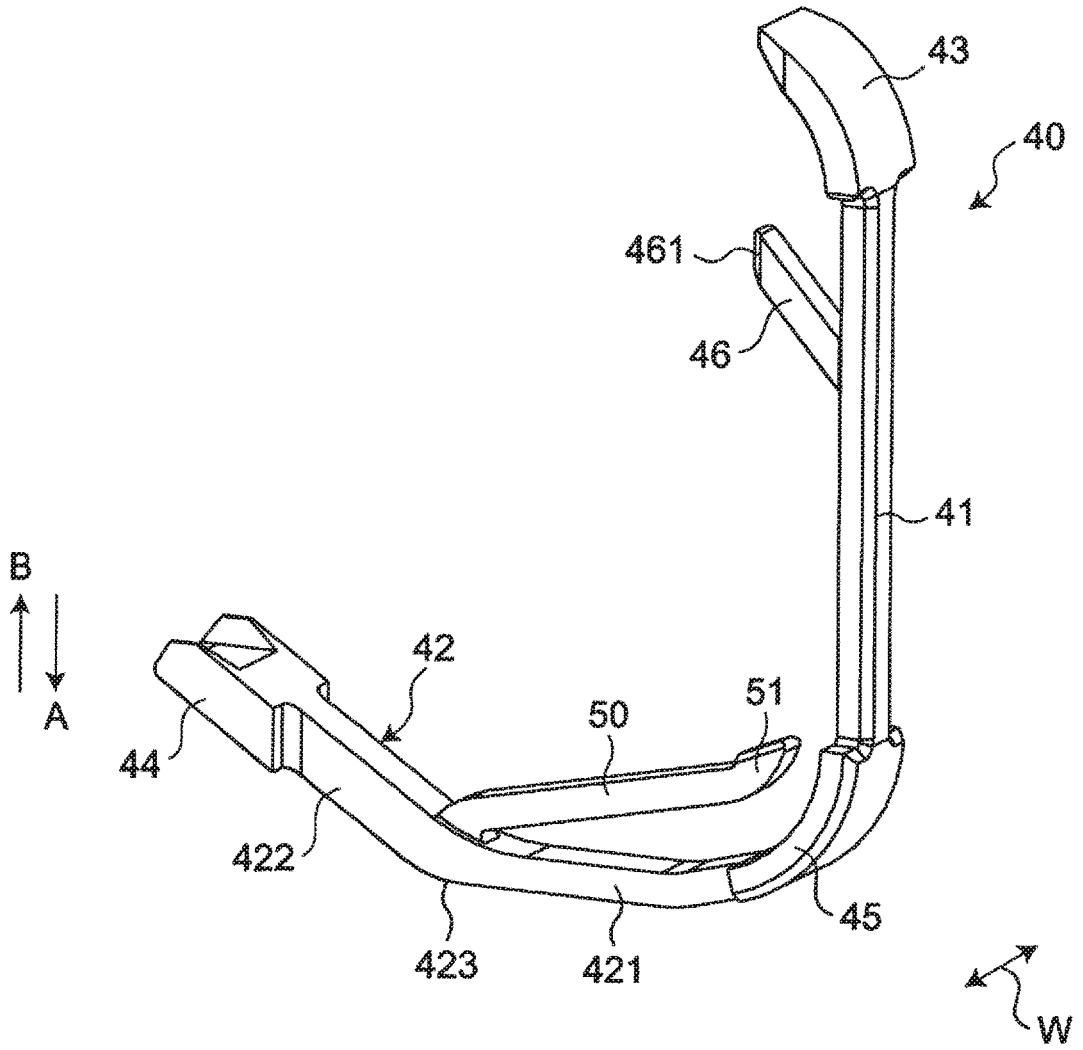
FIG. 3 is a perspective view showing a display-use moveable member of the terminal block shown in FIG. 1.

The main body portion 41 is disposed so as to reciprocate through the moveable member passage portion 63 in the direction intersecting the terminal connection surface 11 and extends from the vicinity of the terminal connection surface 11 to the vicinity of the guide surface 16 in the extension direction of the moveable member passage portion 63. Specifically, the main body portion 41 is configured to reciprocate between a display position P2 (see FIG. 5) at which a distal end portion 43 adjacent to the terminal connection surface 11 in the extension direction is exposed outside the housing 2 through the third opening portion 14 and a non-display position 21 (see FIG. 4) at which the distal end portion 43 is held in the holding portion 10. As shown in FIG. 3, the distal end portion 43 of the main body portion 41 is curved along the curved shape of the curved portion 64 of the moveable member passage portion 63.

Note that, as shown in FIG. 3, the intermediate portion of the main body portion 41 is smaller in size in the width direction W than both end portions in the extension direction. This reduces the weight of the display-use moveable member 40 and allows the main body portion 41 to be easily moved in the direction intersecting the terminal connection surface 11.

The contact moveable portion 42 extends along the guide surface 16, in which a first end portion 44 in the extension direction is disposed so as co come into contact with the conductor portion of the electric wire in the electric wire passage portion 61 and to move in a first direction A intersecting the terminal connection surface 11 and away from the terminal connection surface 11, and a second end portion 45 in the extension direction is connected to the main body portion 41.

Specifically, as shown in FIG. 3, the contact moveable portion 42 has a plate shape with an intermediate portion bent and has a first member 421 and a second member 422.

The first member 421 extends along the guide surface 16 and has one end portion in the extension direction serving as the second end portion 45. A connection portion between the one end portion of the first member 421 (that is, the second end portion 45 of the contact moveable portion 42) and the main body portion 41 has a curved shape curved toward the guide surface 16 in the direction intersecting the terminal connection surface 11. Further, provided at an end portion of the first member 421 adjacent to the second member 422 is an abutting portion 423 that slides on the guide surface 16 in response to movement of the first end portion 44 in the direction intersecting the terminal connection surface 11 (that is, the first direction A, and a second direction B intersecting the terminal connection surface 11 and toward the terminal connection surface 11).

The second member 422 extends in the array direction and toward the terminal connection surface 11 as a distance from the main body portion 41 increases and is resiliently deformable in the first direction A. That is, the second member 422 is inclined relative to the guide surface 16 in a direction in which a distance from the guide surface 16 increases toward the terminal electrode portion 20, and a gap is provided, in the direction intersecting the terminal connection surface 11, between the other end portion in the extension direction serving as the first end portion 4 of the contact moveable portion 42 and the guide surface 16. One end portion of the second member 422 in the extension direction is connected to the other end portion of the first member 421 in the extension direction, and the other end portion of the second member 422 in the extension direction serves as the first end portion 44.

Further, as shown in FIG. 3, the display-use moveable member 40 has a protrusion portion 46 extending from the main body portion 41 in a direction intersecting the extension direction of the main body portion 41. As shown in FIG. 2, the protrusion portion 46 is provided near the distal end portion 43 of the main body portion 41 and extends from the main body portion 41 toward the second opening portion 13. That is, the protrusion portion 46 is inclined relative to the main body portion 41 such that as a distance from the main body portion 41 in the array direction increases toward the vertical plate portion 21 of the terminal electrode portion 20, a distance from the terminal connection surface 11 in the direction orthogonal to the terminal connection surface 11 decreases.

As shown in FIG. 2, the return spring portion 50 is configured to push the main body portion 41 of the display-use moveable member 40 in the first direction A. According to this embodiment, the return spring portion 50 is made of resin, for example, and is provided integrally with the contact moveable portion 42 of the display-use moveable member 40.

Specifically, as shown in FIG. 3, the return spring portion 50 extends from a portion facing the terminal connection surface 11 at a connection portion between the first member 421 and the second member 422 of the contact moveable portion 42 toward the fixed portion 31 of the leaf spring portion 30. A distal end portion 51 of the return spring portion 50 remote from the contact moveable portion 42 in the extension direction of the return spring portion 50 is in contact with the leaf spring fixing portion 17 of the housing 2 in the second direction B as shown in FIG. 2.

Further, as shown in FIG. 2, each of the holding portions 11 has a first movement restriction portion 71, a second movement restriction portion 72, and a third movement restriction 7.

The first movement restriction portion 71 is provided integrally with the housing 2 and is configured to restrict the movement of the moveable portion 32 of the leaf spring portion 30 in the width direction W (that is, a direction orthogonal to the plane of FIG. 2). Specifically, the first movement restriction portion 71 extends, along the electric wire passage portion 61, from between the terminal connection surface 11 and the moveable portion 32 of the leaf spring portion 30 in the direction intersecting the terminal connection surface 11 to the vicinity of the first end portion 44 of the contact moveable portion 42 of the display-use moveable member 40. That is, the first movement restriction portion 71 is disposed so as to cover a region where the moveable portion 32 of the leaf spring portion 30 can move (specifically, a region where the distal end portion 321 of the moveable portion 32 can move) and to guide the conductor portion of the electric wire inserted through the first opening portion 12 into the electric wire passage portion 61 toward the first end portion 44 of the contact moveable portion 42 of the display-use moveable member 40.

The second movement restriction portion 72 is configured to restrict the movement of the contact moveable portion 42 of the display-use moveable member 40 in the width direction W while allowing the contact moveable portion 42 of the display-use moveable member 40 to move in the array direction. Specifically, the second movement restriction portion 72 is provided integrally with the horizontal plate portion 22 of the terminal electrode portion 20 on the guide surface 16 to restrict the movement the abutting portion 423 of the first member 421 of the contact moveable portion 42 of the display-use moveable member 40 in the width direction W.

The third movement restriction portion 73 is provided integrally with the housing 2 and is configured to restrict the movement of the protrusion portion 46 in the width direction W. Specifically, the third movement restriction portion 73 extends from the third opening portion 14 in the first direction A and covers a region where a distal end portion 461 of the protrusion portion 46 can move.

Next, a description will be given of motion of the terminal block 1 when a conductor portion 100 of an electric wire is inserted into the first opening portion 12, and a jig 110 is inserted into the second opening portion 13 with reference to FIGS. 4 to 6.

Figure 4:
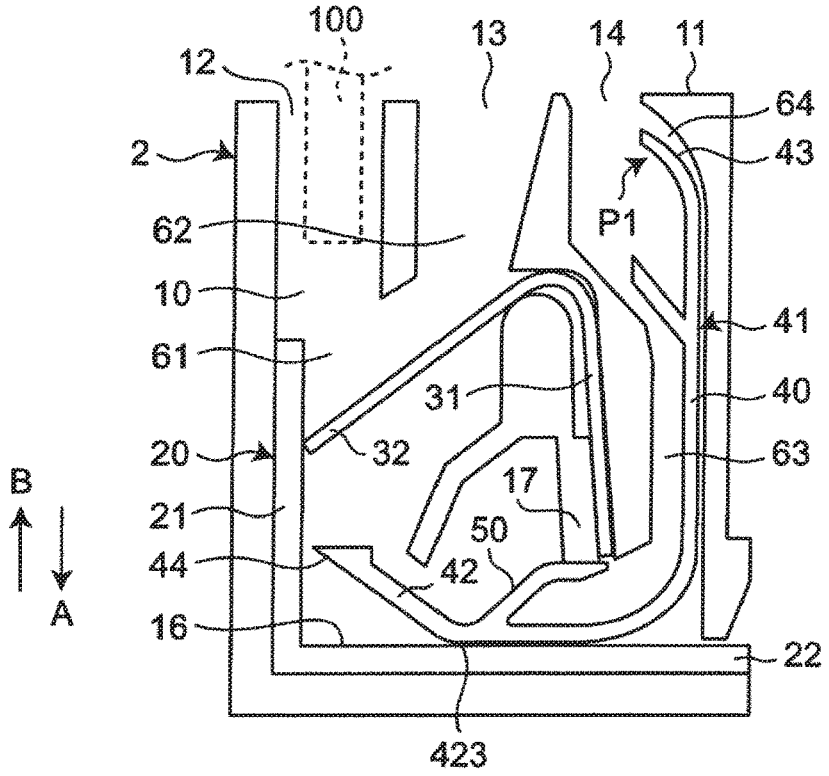
FIG. 4 is a first schematic plan view for describing motion of the terminal block shown in FIG. 1.
Figure 5:
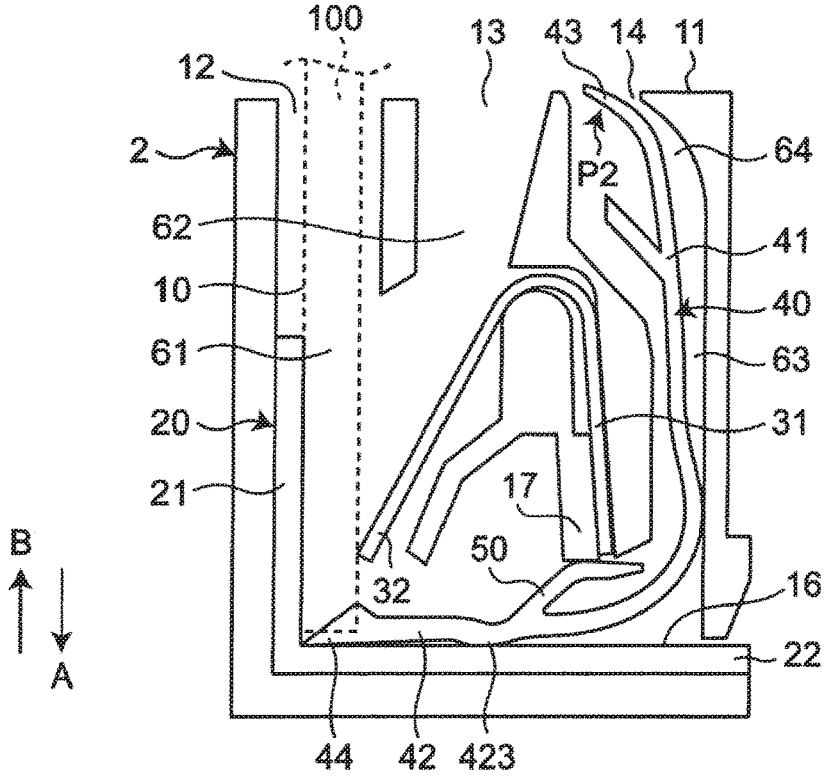
FIG. 5 is a second schematic plan view for describing the motion of the terminal block shown in FIG. 1.

As shown in FIG. 4, when the conductor portion 100 of the electric wire is inserted through the first opening portion 12 of the terminal block 1 into the electric wire passage portion 61 of the holding portion 10, the conductor portion 100 of the electric wire thus inserted comes into contact with the moveable portion 32 of the leaf spring portion 30 to push the moveable portion 32 in the first direction A. This resiliently deforms the moveable portion 32 toward the fixed portion 31 against the resilient force of the moveable portion 32 and then, as shown in FIG. 5, causes the conductor portion 100 of the electric wire to be held between the moveable portion 32 and the vertical plate portion 21 of the terminal electrode portion 20 to bring the conductor portion 100 of the electric wire and the terminal electrode portion 20 into a connected state.

When the conductor portion 100 of the electric wire is further inserted through the first opening portion 12 into the electric wire passage portion 61, the conductor portion 100 of the electric wire pushes and moves the first end portion 44 of the contact moveable portion 42 of the display-use moveable member 40 to the first position in the first direction A. When the first end portion 44 of the contact moveable portion 42 moves in the first direction A, the abutting portion 423 of the contact moveable portion 42 slides on the guide surface 16 in the array direction to separate from the vertical plate portion 21 of the terminal electrode portion 20 (that is, the contact moveable portion 42 moves while being in contact with the guide surface 16), while the distal end portion 43 of the main body portion 41 of the display-use moveable member 40 moves from the non-display position P1 to the display position P2 in the second direction B and is exposed from the holding portion 10 outside the housing 2 through the third opening portion 14. This causes a state where the connection state of the conductor portion 100 of the electric wire with respect to the terminal electrode portion 20 is changed from a disconnected state to the connected state to be displayed.

Figure 6:
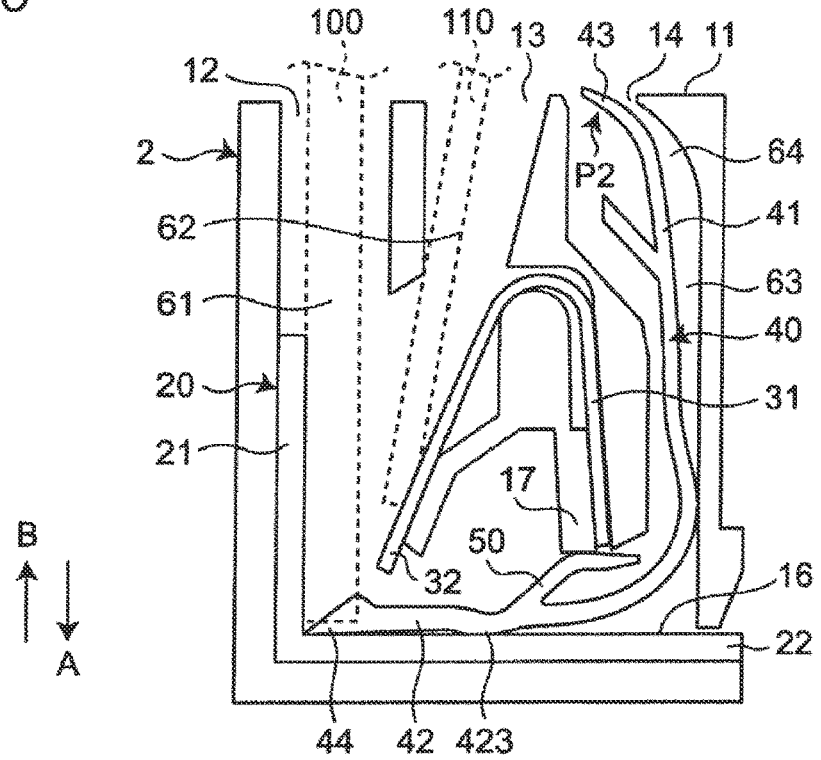
FIG. 6 is a third schematic plan view for describing the motion of the terminal block shown in FIG. 1.
Figure 7:
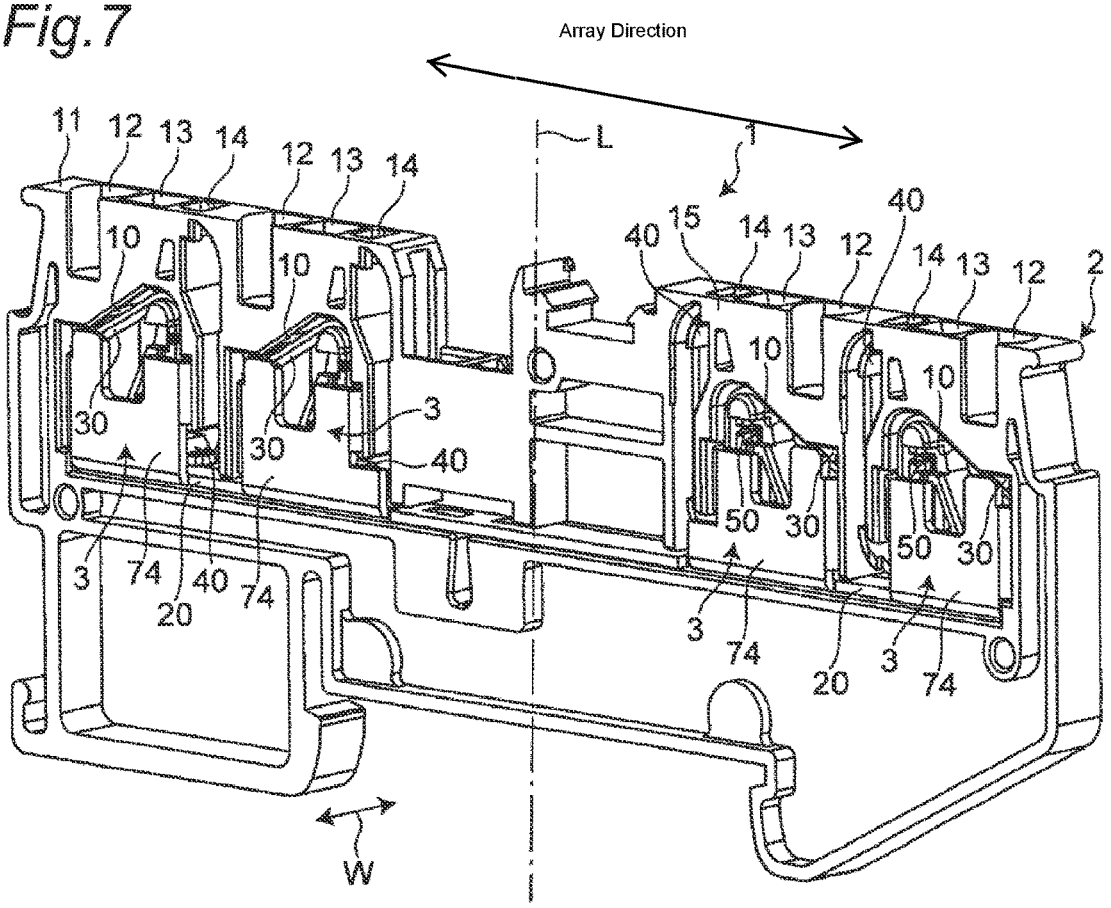
FIG. 7 is a perspective view showing a terminal block according to a second embodiment of the present disclosure.

Subsequently, when the jig 110 is inserted through the second opening portion 13 of the terminal block 1 into the jig passage portion 62 with the conductor portion 100 of the electric wire and the terminal electrode portion 20 shown in FIG. 5 in the connected state, as shown in FIG. 6, a tip of the jig 110 comes into contact with the moveable portion 32 of the leaf spring portion 30 to resiliently deform the moveable portion 32 toward the fixed portion 31 against the resilient force of the moveable portion 32. This releases the contact between the moveable portion 32 and the conductor portion 100 of the electric wire to bring the conductor portion 100 of the electric wire and the terminal electrode portion 20 into the disconnected state. Thereafter, the conductor portion 100 of the electric wire in the holding portion 10 can be pulled out from the holding portion 10.

When the conductor portion 100 of the electric wire is pulled out from the holding portion 10, the main body portion 41 of the display-use moveable member 40 moves in the first direction A by pushing force of the return spring portion 50, while the first end portion 44 of the contact moveable portion 42 pushed by the conductor portion 100 in the first direction A moves in the second direction B by its own resilient force, and the display-use moveable member 40 returns to the position shown in FIG. 4. At this time, the distal end portion 43 of the main body portion 41 exposed outside the housing 2 through the third opening portion 14 moves from the display position P2 to the non-display position P1 in the second direction B and is held in the holding portion 10. This causes a state where the connection state of the conductor portion 100 of the electric wire with respect to the terminal electrode portion 20 is changed from the connected state to the disconnected state to be displayed.

As described above, the terminal block 1 includes the display-use moveable member 40 having the main body portion 41 that extends in the direction intersecting the terminal connection surface 11 and can reciprocate between the display position P2 where the distal end portion 43 in the extension direction is exposed outside the housing 2 through the third opening portion 14 and the non-display position P1 where the distal end portion 43 is held in the holding portion 10, and the contact moveable portion 42 that extends along the guide surface 16, has the first end portion 44 in the extension direction disposed so as to come into contact with the conductor portion 100 of the electric wire to move in the first direction A away from the terminal connection surface 11 in the electric wire passage portion 61, has the second end portion 45 in the extension direction connected to the main body portion 41, and moves in the array direction in response to the movement of the first end portion 44 in the first direction A to move the main body portion 41 in the second direction B toward the terminal connection surface 11. With the display-use moveable member 40, when the conductor portion 100 of the electric wire is inserted through the first opening portion 12 into the electric wire passage portion 61 to move the first end portion 44 of the contact moveable portion 42 in the first direction A, the distal end portion 43 of the main body portion 41 is exposed from the holding portion 10 outside the housing 2 through the third opening portion 14 to display a state where the connection state of the conductor portion 100 with respect to the terminal electrode portion 20 is changed from the disconnected state to the connected state. Further, when the conductor portion 100 of the electric wire is pulled out from the electric wire passage portion 61, the main body portion 41 moves in the first direction A by the pushing force of the return spring portion 50, and accordingly the distal end portion 43 exposed outside the housing 2 through the third opening portion 14 is held in the holding portion 10 to display a state where the connection state of the conductor portion 100 with respect to the terminal electrode portion 20 is changed from the connected state to the disconnected state. That is, since the terminal block 1 is capable of displaying whether the connection state of the conductor portion 100 with respect to the terminal electrode portion 20 is the connected state or the disconnected state through the third opening portion 14 by not a rotary motion but a linear motion of the distal end portion 43 of the display-use moveable member 40 in the direction intersecting the terminal connection surface 11, even when the terminal block 1 is reduced in size, a region where the display-use moveable member 40 can move can be secured in the holding portion 10. As a result, even when the terminal block 1 is reduced in size, the user can be notified of the accurate connection status of the electric wire.

Further, the holding portion 10 has the moveable member passage portion 63 that extends in the direction intersecting the terminal connection surface 11, communicates with the third opening portion 14, is disposed so as to cause the third opening portion 14 to be located between the moveable member passage portion 63 and the second opening portion 13 in the array direction, and through which the main body portion 41 of the display-use moveable member 40 can move. With such a configuration, it is possible to make, when the distal end portion 43 of the main body portion 41 of the display-use moveable member 40 is located in the holding portion 10 (that is, when the connection state of the conductor portion 100 with respect to the terminal electrode portion 20 is the disconnected state), the distal end portion 43 of the main body portion 41 less prone to be exposed outside the housing 2 through the third opening portion 14 in the direction orthogonal to the terminal connection surface 11. This in turn makes it possible to prevent erroneous determination that the connection state of the conductor portion 100 with respect to the terminal electrode portion 20 is the connected state even though the connection state of the conductor portion 100 with respect to the terminal electrode portion 20 is the disconnected state and therefore makes it possible to notify the user of the connection status of the electric wire more accurately.

Further, the moveable member passage portion 63 has the curved portion 64 provided at the end portion adjacent to the third opening portion 14 and curved in the second direction B and toward the second opening portion 13, and the distal end portion 43 of the main body portion 41 of the display-use moveable member 40 is curved along the curved shape of the curved portion 64. Such a configuration makes it possible to easily move the main body portion 41 of the display-use moveable member 40 in the direction intersecting the terminal connection surface 11 with small force.

Further, the display-use moveable member 40 and the return spring portion 50 are provided integrally. This makes it possible to realize the terminal block 1 that can suppress an increase in the number of components and make manufacturing cost lower.

Further, the contact moveable portion 42 of the display-use moveable member 40 has the first member 421 that extends along the guide surface 16, has the one end portion in the extension direction serving as the second end portion 45, and has the abutting portion 423 that slides on the guide surface 16 in response to the movement of the first end portion 44 in the first direction A and the second direction B, and the second member 422 that extends in the array direction and toward the terminal connection surface 11 as a distance from the main body portion 41 increases, has the one end portion in the extension direction connected to the other end portion of the first member 421, and has the other end portion in the extension direction serving as the first end portion 44. This makes it possible to display, with a simple configuration, whether the connection state of the conductor portion 100 with respect to the terminal electrode portion 20 is the connected state or the disconnected state through the third opening portion 14.

Further, in the terminal block 1, the housing 2 is integrally provided with the first movement restriction portion 71 that restricts the movement of the moveable portion 32 of the leaf spring portion 30 in the width direction W. The first movement restriction portion 71 can prevent the leaf spring portion 30 from failing off from the housing 2 through the opening surface 15 of the holding portion 10 without providing a separate component such as a lid that covers the opening portion of the opening surface 15 of the holding portion 10, thereby making it possible to realize the terminal block 1 that can suppress an increase in the number of components and make the manufacturing cost lower.

Further, the first movement restriction portion 71 is configured to cover a region where the moveable portion 32 of the leaf spring portion 30 can move. This makes it possible to more reliably prevent the leaf spring portion 30 from falling off from the housing 2 through the opening surface 15 of the holding portion 10.

Further, the terminal block 1 further includes the display-use moveable member 40 and the second movement restriction portion 72 disposed in the holding portion 10, and the holding portion has the guide surface 16 extending in the array direction. Then, the second movement restriction portion 72 restricts the movement of the contact moveable portion 42 of the display-use moveable member 40 in the width direction W while allowing the movement of the contact moveable portion 42 of the display-use moveable member 40 in the array direction. The second movement restriction portion 72 can prevent the display-use moveable member 40 from falling off from the housing 2 through the opening surface 15 of the holding portion 10 without providing a separate component such as a lid that covers the opening portion of the opening surface 15 of the holding portion 10, thereby making it possible to realize the terminal block 1 that can suppress an increase in the number of components and make the manufacturing cost lower.

Further, the contact moveable portion 42 of the display-use moveable member 40 has the first member 421 that extends along the guide surface 16, has the one end portion in the extension direction serving as the second end portion 45, and has the abutting portion 423 that slides on the guide surface 16 in response to the movement of the first end portion 44 in the first direction A and the second direction B, and the second member 422 that extends in the array direction and toward the terminal connection surface 11 as a distance from the main body portion 41 increases, has the one end portion in the extension direction connected to the other end portion of the first member 421, and has the other end portion in the extension direction serving as the first end portion 44, and the second movement restriction portion 72 is disposed so as to restrict the movement of the abutting portion 423 of the first member 421 in the width direction W. This makes it possible to more reliably prevent the display-use moveable member 40 from falling off from the housing 2 through the opening surface 15 of the holding portion 10.

Further, the display-use moveable member 40 has the protrusion portion 46 extending from the main body portion 41 in the direction intersecting the extension direction of the main body portion 41, and the housing 2 is integrally provided with the third movement restriction portion 73 that restricts the movement of the protrusion portion 46 in the width direction W. The third movement restriction portion 73 can more reliably prevent the splay-use moveable member 40 from falling off from the housing 2 through the opening surface 15 of the holding portion 10 without providing a separate component such as a lid that covers the opening portion of the opening surface 15 of the holding portion 10.

Further, the protrusion portion 46 extends from the main body portion 41 toward the second opening portion 13 and is disposed near the distal end portion 43 of the main body portion 41. This makes it possible to increase space efficiency in holding portion 10 and realize the terminal block 1 that can be reduced in size.

Further, the first movement restriction portion 71 is disposed extending along the electric wire passage portion 61 and guides the conductor portion 100 of the electric wire inserted through the first opening portion 12 into the electric wire passage portion 61 toward the first end portion 44 of the contact moveable portion 42 of the display-use moveable member 40. That is, inserting the conductor portion 100 of the electric wire through the first opening portion 12 into the electric wire passage portion 61 makes it possible to reliably move the first end portion 44 of the contact moveable portion 42 of the display-use moveable member 40 in the first direction A. This makes it possible to display whether the connection state of the conductor portion 100 with respect to the terminal electrode portion 20 is the connected state or the disconnected state through the third opening portion 14.

Note that it is not limited to the configuration where the moveable member passage portion 63 is disposed so as to cause the third opening portion 14 to be located between the moveable member passage portion 63 and the second opening portion 13 in the array direction, but the moveable member passage portion 63 and the third opening portion 14 may be, for example, arranged on an imaginary straight line extending in the direction intersecting the terminal connection surface 11. This configuration makes it possible to eliminate the curved portion 64 of the moveable member passage portion 63. Further, the distal end portion 43 of the main body portion 41 of the display-use moveable member 40 can have any shape suitable for displaying the connection state of the conductor portion 100 with respect to the terminal electrode portion 20.

The return spring portion 50 may be configured to push the main body portion 41 of the display-use moveable member 40 in the first direction A. For example, to return spring portion 50 may be provided separately from the display-use moveable member 40.

It is not limited to the configuration where the contact moveable portion 42 of the display-use moveable member 40 has the first member 421 and the second member 422. The contact moveable portion 42 may have any configuration as long as the contact moveable portion 42 is configured to move in the array direction in response to the movement of the first end portion 44 in the first direction A to move the main body portion 41 in the second direction B.

It is not limited to the configuration where the guide surface 16 is provided on the horizontal plate portion 22 of the terminal electrode portion 20, but the guide surface 16 may be provided on the holding portion 10 of the housing 2, for example.

The first movement restriction portion 71, the second movement restriction portion 72, and the third movement restriction portion 73 may be eliminated. For example, any one of the first movement restriction portion 71, the second movement restriction portion 72, and the third movement restriction portion 73 may be eliminated, any two of the first movement restriction portion 71, the second movement restriction portion 72, and the third movement restriction portion 73 may be eliminated, or all of the first movement restriction portion 71, the second movement restriction portion 72, and the third movement restriction portion 73 may be eliminated. When the third movement restriction portion 73 is eliminated, the protrusion portion 46 of the main body portion 41 of the display-use moveable member 40 can also be eliminated.

It is not limited to the configuration where the protrusion portion 46 extends from the main body portion 41 toward the second opening portion 13 and is disposed near the distal end portion 43 of the main body portion 41, but the protrusion portion 46 may be disposed at any position on the main body portion 41 in accordance with the design of the terminal block 1 or the like.

Second Embodiment

As shown in FIGS. 7 to 10, a terminal block 1 according to a second embodiment of the present disclosure differs from the terminal block 1 according to the first embodiment in the following points. Note that, in the second embodiment, the same components as the components according to the first embodiment will be denoted by the same reference numerals, no description will be given of the same components, and a description will be given of only different points from the first embodiment.

Including four terminal connection portions 3.

Including a fourth movement restriction portion 74 serving as both the first movement restriction portion 71 and the second movement restriction portion 72.

The contact moveable portion 42 includes a third member 424.

The third movement restriction portion 73 and the protrusion portion 46 of the display-use moveable member 40 are eliminated.

The return spring portion 50 has a metal member.

In the terminal block 1 according to the second embodiment, the housing has four holding portions 10, two of which are located on the left side of the imaginary straight line L and the other two are located on the right side of the imaginary straight line L. The terminal connection portion 3 is held in each of the holding portions 10.

Figure 8:
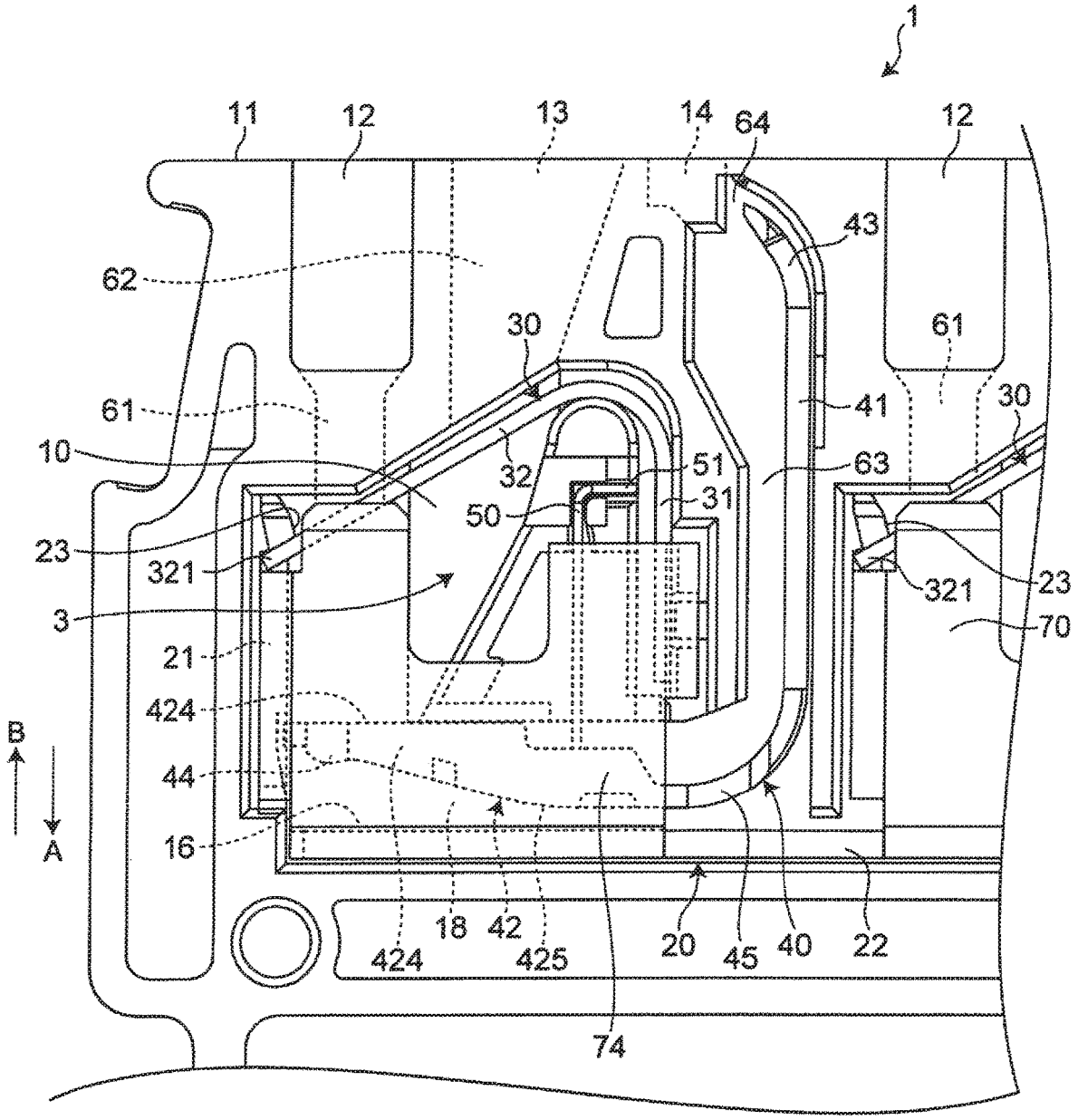
FIG. 8 is an enlarged plan view showing a holding portion and a terminal connection portion of the terminal block shown in FIG. 7.

As shown in FIG. 8, the fourth movement restriction portion 74 is provided integrally with the terminal electrode portion 20 and covers a part of the opening portion of the opening surface 15 of each of the holding portions 10. According to the second embodiment, the fourth movement restriction portion 74 has an approximately rectangular plate shape, and has one of sides extending in a short-side direction (that is, a left side in FIG. 8) connected to the vertical plate portion 21 and has one of sides extending in a long-side direction (that is, a lower side in FIG. 8) connected to the horizontal plate portion 22. The fourth movement restriction portion 74 covers a part of the electric wire passage portion 61, a part of the fixed portion 31 of the leaf spring portion 30, and a part of the contact moveable portion 42 of the display-use moveable member 40 and restricts the movement of the leaf spring portion 30 and the movement of the display-use moveable member 40 in the width direction W of the housing 2 (shown in FIG. 7).

Figure 9:
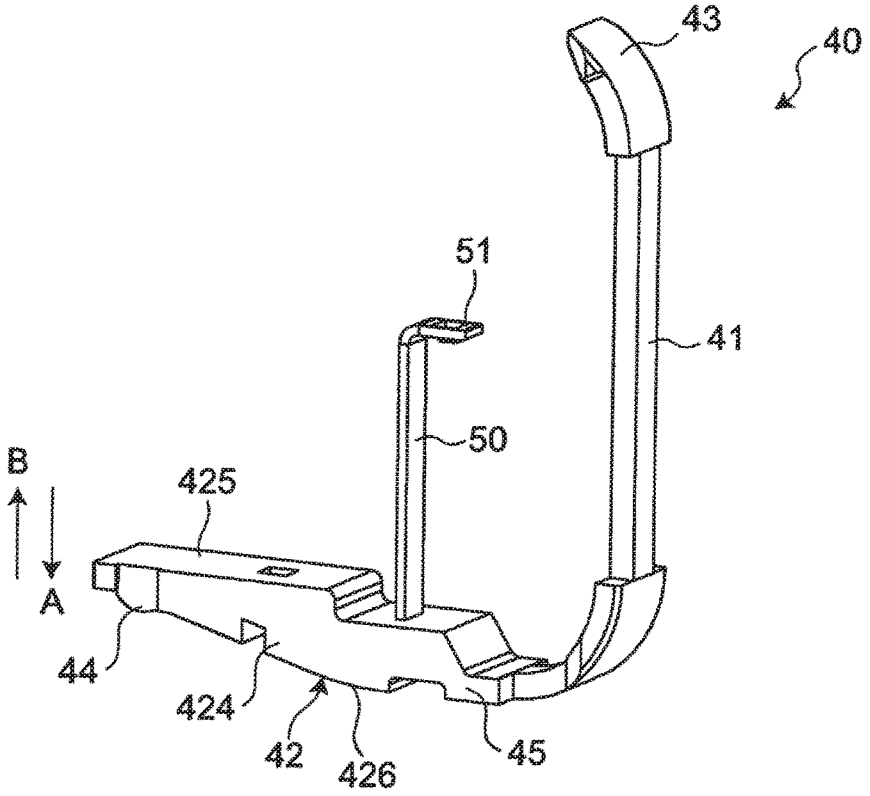
FIG. 9 is a perspective view showing a display-use moveable member of the terminal block shown in FIG. 7.

As shown in FIG. 9, the contact moveable portion 42 includes the third member 424 extending along the guide surface 16. The third member 424 has a contact surface 425 that faces the terminal connection surface 11 and where the conductor portion of the electric wire can come into contact with, and a curved surface 426 that faces the guide surface 16 and is curved toward the guide surface 16. As shown in FIG. 8, a gap 18 is formed between the curved surface 426 of the third member 424 and the guide surface 16 in the direction intersecting the terminal connection surface 11. That is, in the terminal block 1 according to the second embodiment, when the first end portion 44 moves in the first direction A, the contact moveable portion 42 moves in the array direction without coming into contact with the guide surface 16 to move the main body portion 41 in the second direction B toward the terminal connection surface 11. That is, the gap 18 formed between the third member 424 and the guide surface 16 facilitates the movement of the contact moveable portion 42 in the array direction. Note that, as in the terminal block 1 according to the first embodiment, the contact moveable portion 42 may be configured to move in the array direction while being in contact with the guide surface 16.

Figure 10:
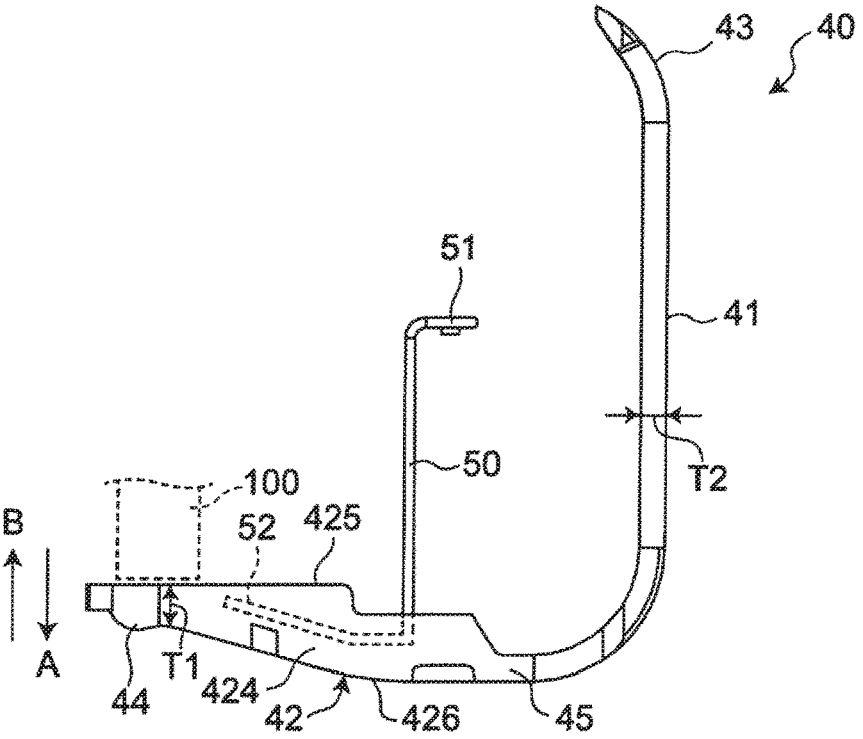
FIG. 10 is a plan view showing the display-use moveable member of the terminal block shown in FIG. 7.

As shown in FIG. 10, the contact moveable portion 42 is configured to have a thickness T1 of the first end portion 44 larger than a thickness of the main body portion 41. The thickness T1 of the first end portion 44 of the contact moveable portion 42 can be calculated, for example, from an average thickness value or minimum thickness value of a portion of the contact moveable portion 42 where the conductor portion 100 of the electric wire comes into contact with.

As an example, the return spring portion 50 is configured by a leaf spring disposed extending in the direction intersecting (for example, orthogonal to) the terminal connection surface 11. Specifically, as shown in FIG. 8, the return spring portion 50 is provided integrally with the contact moveable portion 42 between the first end portion 44 and the second end portion 45 of the contact moveable portion 42 in the array direction and extends approximately parallel to the fixed portion 31. The distal end portion 51 of the return spring portion 50 remote from the guide surface 16 in the extension direction of the return spring portion 50 is bent toward the main body portion 41 and is fixed to the housing 2. A proximal end portion 52 of the return spring portion 50 adjacent to the guide surface 16 in the extension direction of the return spring portion 50 is bent away from the main body portion 41 and is disposed inside the contact moveable portion 42, as shown in FIG. 10.

When the return spring portion 50 is made of only resin as in the terminal block 1 according to the first embodiment, for example, under an environment where high heat exceeding 100 degrees Celsius is applied to the terminal block 1, the return spring portion 50 is deformed, and in some cases, resiliency required for returning the display-use moveable member 40 (that is, for moving the distal end portion 43 of the main body portion 41 from the display position P2 to the non-display position P1) cannot be maintained. In the terminal block 1 according to the second embodiment, since the return spring portion 50 has a metal member, it is possible to reduce deformation, due to heat, of the return spring portion 50. As a result, even under the environment where high heat exceeding 100 degrees Celsius is applied, the resiliency required for returning the display-use moveable member 40 can be maintained.

Further, the return spring portion 50 is configured by a leaf spring disposed extending in the direction intersecting the terminal connection surface 11. This makes it possible to reduce, with a simple configuration, deformation, due to heat, of the return spring portion 50. As a result, even under the environment where high heat exceeding 100 degrees Celsius is applied, the resiliency required for returning the display-use moveable member 40 can be maintained. Further, since the return spring portion 50 is disposed extending in the direction intersecting the terminal connection surface 11, that is, in a direction in which the conductor portion of the electric wire is inserted and pulled out, the holding portion 10 can be reduced in space.

Further, the return spring portion 50 is provided integrally with the contact moveable portion 42 between the first end portion 44 and the second end portion 45 of the contact moveable portion 42 in the array direction, and the one end portion 52 of the return spring portion 50 is bent in the array direction and is disposed inside the contact moveable portion 42. Such a configuration makes it possible to increase rigidity of the contact moveable portion 42 and in turn makes it possible to suppress deformation of the contact moveable portion 42 even when the display-use moveable member 40 is reduced in size. As a result, even when the terminal block 1 is reduced in size, the user can be notified of the accurate connection status of the electric wire.

Further, the contact moveable portion 42 has a plate shape and is configured to have the thickness T1 of the first end portion 44 larger than the thickness T2 of the main body portion 41. Such a configuration makes it possible to increase rigidity of the contact moveable portion 42 and in turn makes it possible to suppress deformation of the contact moveable portion 42 even when the display-use moveable member 40 is reduced in size. As a result, even when the terminal block 1 is reduced in size, the user can be notified of the accurate connection status of the electric wire.

Figure 11:
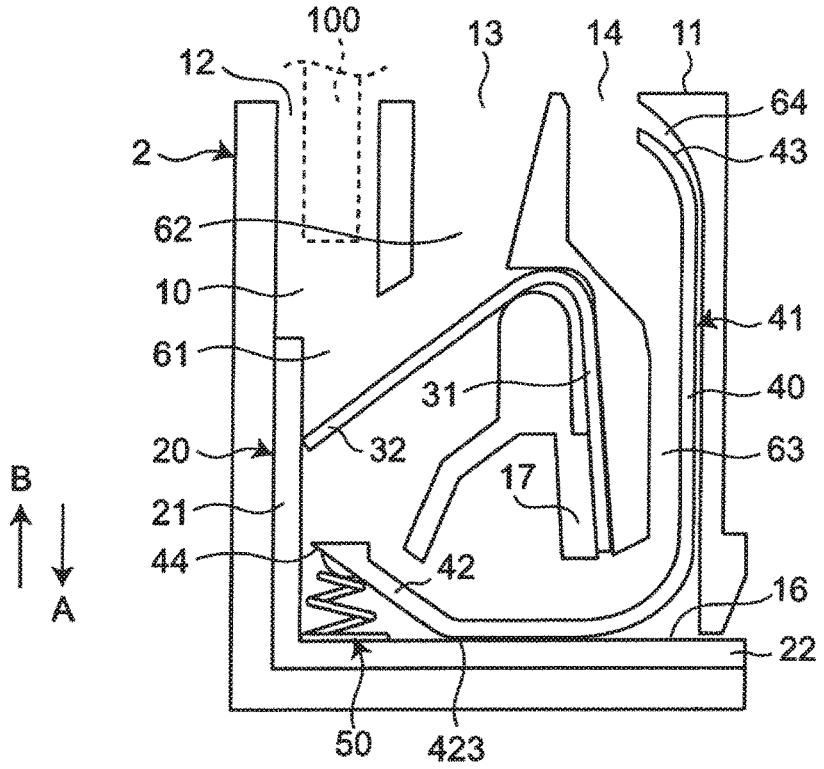
FIG. 11 is a schematic plan view showing a first modification of the terminal block shown in FIG. 7.

Note that the return spring portion 50 only needs to have the metal member, and it is not limited to the configuration where the return spring portion 50 is provided integrally with the contact moveable portion 42. For example, as shown in FIG. 11, a conical spring may be used as the return spring portion 50. The return spring portion 50 shown in FIG. 11 is disposed in contact with the first end portion 44 of the contact moveable portion 42 and the horizontal plate portion 22 of the terminal electrode portion 20.

Figure 12:
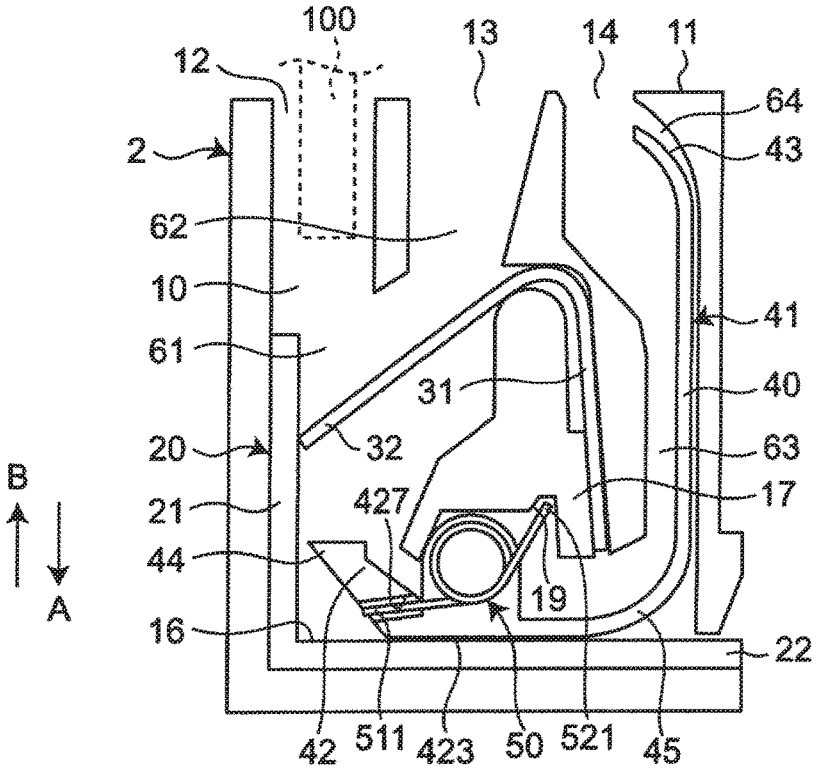
FIG. 12 is a schematic plan view showing a second modification of the terminal block shown in FIG. 7.
Figure 13:
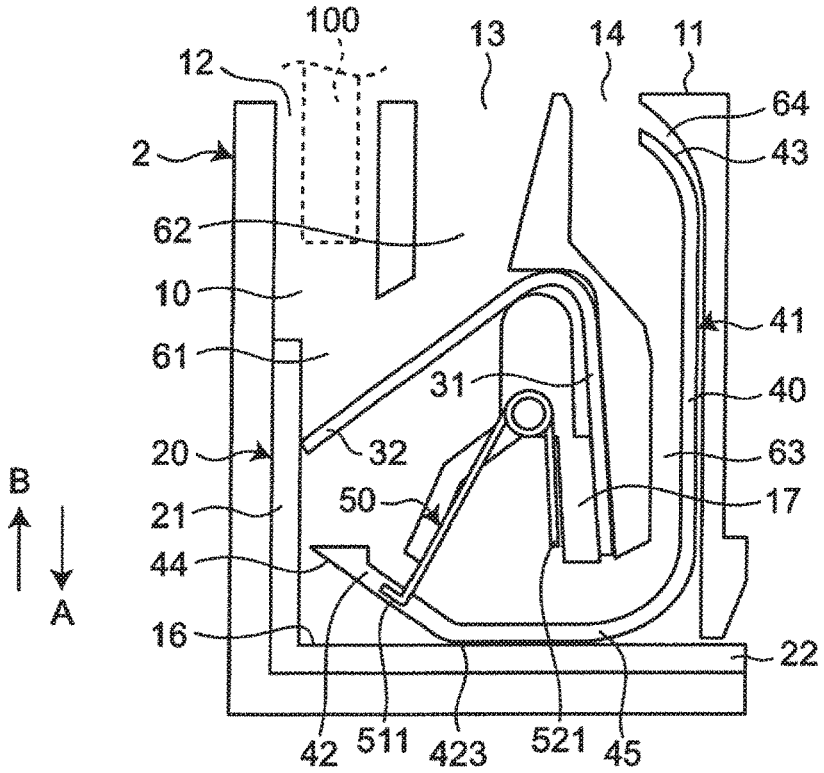
FIG. 13 is a schematic plan view showing a third modification of the terminal block shown in FIG. 7.

Further, as shown in FIGS. 12 and 13, a torsion spring may be used as the return spring portion 50. The return spring portion 50 shown in FIG. 12 is disposed in the middle of the contact moveable portion 42, and has one end 511 extending toward the first end portion 44 of the contact moveable portion 42 in the array direction and held in a groove portion 427 provided on the contact moveable portion 42 to be integrated with the contact moveable portion 42. Further, the other end 521 of the return spring portion 50 extends toward the second end portion 45 of the contact moveable portion 42 and is caught on and fixed to a locking portion 19 provided near the leaf spring fixing portion 17 of the housing 2. In the terminal block 1 shown in FIG. 12, as the first end portion 44 of the contact moveable portion 42 is moved in the first direction A by the conductor portion 100 of the electric wire, the one end 511 of the return spring portion 50 comes into contact with the guide surface 16 and then becomes gradually closer to the other end 521. This pushes the contact moveable portion 42 in the second direction B. The return spring portion 50 shown in FIG. 13 is provided between the fixed portion 31 and the moveable portion 32 of the leaf spring portion 30 in the array direction and between the leaf spring portion 30 and the contact moveable portion 42 in the direction intersecting the terminal connection surface 11. The one end 511 of the return spring portion 50 shown in FIG. 13 extends toward the first end portion 44 of the contact moveable portion 42 and has a tip connected to the contact moveable portion 42. The other end 521 of the return spring portion 50 shown in FIG. 13 extends toward the second end portion 45 of the contact moveable portion 42. In the terminal block 1 shown in FIG.

13, as the first end portion 44 of the contact moveable portion 42 is moved in the first direction A by the conductor portion 100 of the electric wire, the one end 511 of the return spring portion 50 becomes gradually closer to the other end 521. This pushes the contact moveable portion 42 in the second direction B.

Figure 14:
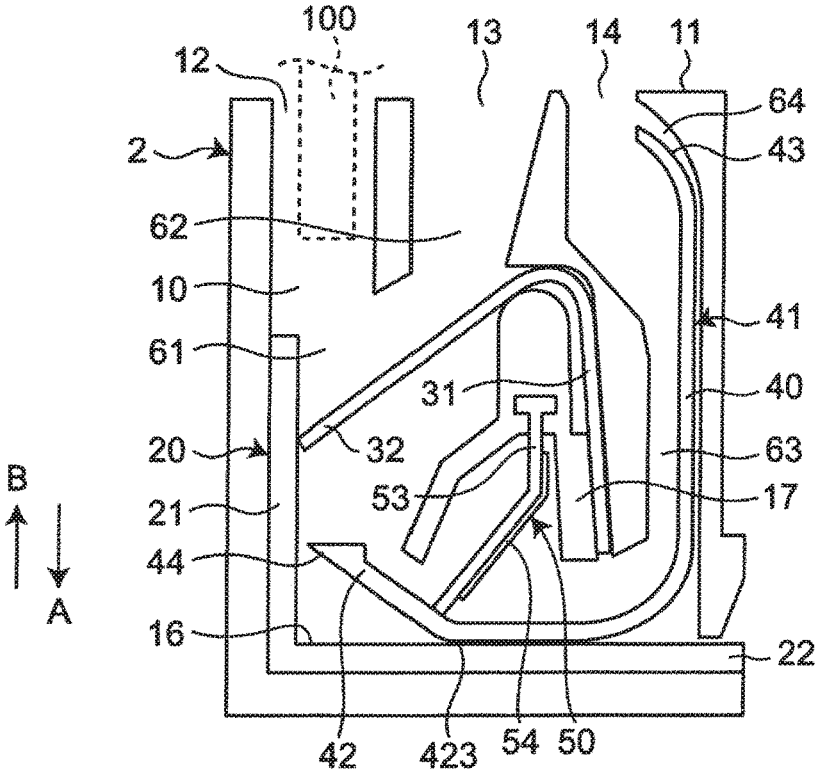
FIG. 14 is a schematic plan view showing a fourth modification of the terminal block shown in FIG. 7.

Further, as shown in FIG. 14, the return spring portion 50 may be configured by a resin spring 53 and a leaf spring 54. In the return spring portion 50 shown in FIG. 14, the resin spring 53 extends from the middle of the contact moveable portion 42 in the second direction B and has a tip fixed to the housing 2 between the fixed portion 31 and the moveable portion 32 of the leaf spring portion 30 in the array direction. The leaf spring 54 extends along the resin spring 53 and is provided integrally with the resin spring 53. In the terminal block 1 shown in FIG. 14, for example, a slit may be provided in the resin spring 53, and the leaf spring 54 may be held in the slit.

It is not limited to the configuration where the contact moveable portion 42 has the thickness T1 of the first end portion 44 larger than the thickness T2 of the main body portion 41, but the thickness T1 of the first end portion 44 may be equal to the thickness T2 of the main body portion 41.

Although the various embodiments of the present disclosure have been described in detail with reference to the drawings, a description will be given in conclusion of various aspects of the present disclosure. Note that the following description will be given as an example with the reference numerals attached.

A terminal block 1 according to a first aspect of the present disclosure includes:

a housing 2 having insulation properties, the housing 2 having a holding portion 10 provided in the housing 2 and a terminal connection surface 11, a first opening portion 12 through which a conductor portion of an electric wire can be inserted and pulled out, a second opening portion 13 that is adjacent to the first opening portion 12 and through which a jig can be inserted and pulled out, and a third opening portion 14 that is adjacent to the second opening portion 13 and through which a connection state of the conductor portion can be displayed are arranged in series on the terminal connection surface 11 and each communicate with the holding portion 10; and a terminal electrode portion 20, a leaf spring portion 30, a display-use moveable member 40, and a return spring portion 50 that are disposed in the holding portion 10, in which the holding portion 10 has an electric wire passage portion 61 that extends in a direction intersecting the terminal connection surface 11, communicates with the first opening portion 12, and through which the conductor portion of the electric wire can move, a jig passage portion 62 that extends in the direction intersecting the terminal connection surface 11, communicates with the second opening portion 13, and through which the jig can move, and a guide surface 16 that extends in an array direction of the first opening portion 12, the second opening portion 13, and the third opening portion 14 and is disposed so as to cause the electric wire passage portion 61 and the jig passage portion 62 to be interposed between the guide surface 16 and the terminal connection surface 11 in the direction intersecting the terminal connection surface 11, the terminal electrode portion 20 has a contact portion 23 that extends along the electric wire passage portion 61 and is disposed so as to come into contact with the conductor portion inserted through the first opening portion 12 into the electric wire passage portion 61, the leaf spring portion 30 has a fixed portion 31 that is provided at one end portion of the leaf spring portion 30 and is fixed to the housing 2 to cause the electric wire passage portion 61 and the jig passage portion 62 to be located between the fixed portion 31 and the contact portion 23 of the terminal electrode portion 20 in the array direction, and a moveable portion 32 that is provided at the other end of the leaf spring portion 30 and is disposed between the fixed portion 31 and the terminal electrode portion 20 in the array direction, the moveable portion 32 facing the contact portion 23 of the terminal electrode portion 20, extending over the electric wire passage portion 61 and the jig passage portion 62, and being moveable relative to the fixed portion 31, the moveable portion 32 is disposed so as to cause the conductor portion inserted through the first opening portion 12 into the electric wire passage portion 61 to be held between the moveable portion 32 and the contact portion 23 of the terminal electrode portion 20 to bring the conductor portion and the terminal electrode portion 20 into a connected state and to come into contact with the jig inserted through the second opening portion 13 into the jig passage portion 62 to release the contact between the moveable portion 32 and the conductor portion to bring the conductor portion and the terminal electrode portion 20 into a disconnected state, the display-use moveable member 40 has a main body portion 41 that extends in the direction intersecting the terminal connection surface 11 and can reciprocate between a display position P2 where a distal end portion 43 in an extension direction is exposed outside the housing 2 through the third opening portion 14 and a non-display position P1 where the distal end portion 43 is held in the holding portion 10, and a contact moveable portion 42 that extends along the guide surface 16, has a first end portion 44 in an extension direction that is disposed so as to come into contact with the conductor portion in the electric wire passage portion 61 and move in a first direction A intersecting the terminal connection surface 11 and away from the terminal connection surface 11, and has a second end portion 45 in the extension direction that is connected to the main body portion 41, and moves in the array direction in response to movement of the first end portion 44 in the first direction A to move the main body portion 41 in a second direction B intersecting the terminal connection surface 11 and toward the terminal connection surface 11, the return spring portion 50 is configured to push the main body portion 41 of the display-use moveable member 40 in the first direction A, when the conductor portion is inserted through the first opening portion 12 into the electric wire passage portion 61 to move the first end portion 44 of the contact moveable portion 42 in the first direction A, the main body portion 41 moves in the second direction B, and the distal end portion 43 of the main body portion 41 adjacent to the terminal connection surface 11 moves from the non-display position P1 to the display position P2 to display a state where the connection state of the conductor portion with respect to the terminal electrode portion 20 is changed from the disconnected state to the connected state, and when the conductor portion is pulled out from the electric wire passage portion 61 to move the main body portion 41 in the first direction A by pushing force of the return spring portion 50, the distal end portion 43 moves from the display position P2 to the non-display position P1 to display a state where the connection state of the conductor portion with respect to the terminal electrode portion 20 is changed from the connected state to the disconnected state.

Since the terminal block 1 according to the first aspect is capable of displaying whether the connection state of the conductor portion 100 with respect to the terminal electrode portion 20 is the connected state or the disconnected state through the third opening portion not a rotary motion but a linear motion of the distal end portion 43 of the display-use moveable member 40 in the direction intersecting the terminal connection surface 11, even when the terminal block 1 is reduced in size, a region where the display-use moveable member 40 can move can be secured in the holding portion 10. As a result, even when the terminal block 1 is reduced in size, the user can be notified of the accurate connection status of the electric wire.

In the terminal block 1 according to a second aspect of the present disclosure, the holding portion 10 has a moveable member passage portion 63 that extends in the direction intersecting she terminal connection surface 11, communicates with the third opening portion 14, is disposed between the terminal connection surface 11 and the guide surface 16 in the direction intersecting the terminal connection surface 11, is disposed so as to cause the third opening portion 14 to be located between the moveable member passage portion 63 and the second opening portion 13, and through which the main body portion 41 of the display-use moveable member 40 can move.

With the terminal block 1 according to the second aspect, it is possible to make, when the distal end portion 43 of the main body portion 41 of the display-use moveable member 40 is located in the holding portion 10, the distal end portion 43 of the main body portion 41 less prone to be exposed outside the housing 2 through the third opening portion 14 in the direction orthogonal to the terminal connection surface 11. As a result, the user can be notified of the accurate connection status of the electric wire.

In the terminal block 1 according to a third aspect of the present disclosure, the moveable member passage portion 63 has a curved portion 64 provided at an end portion adjacent to the third opening portion 14 and curved in the second direction B toward the second opening portion 13, and the distal end portion 43 of the main body portion 41 of the display-use moveable member 40 is curved along the curved shape of the curved portion 64.

With the terminal block 1 according to the third aspect, it is possible to easily move the main body portion 41 of the display-use moveable member 40 in the direction intersecting the terminal connection surface 11 with small force.

In the terminal block 1 according to a fourth aspect of the present disclosure, the display-use moveable member 40 and the return spring portion 50 are provided integrally.

With the terminal block 1 according to the fourth aspect, it is possible to realize the terminal block 1 that can suppress an increase in the number of components and make manufacturing cost lower.

In the terminal block 1 according to a fifth aspect of the present disclosure, the contact moveable portion 42 of the display-use moveable member 40 has a first member 421 that extends along the guide surface 16, has one end portion in an extension direction serving as the second end portion 45, and has the abutting portion 423 that slides on the guide surface 16 in response to the movement of the first end portion 44 in the first direction A and the second direction B, and a second member 422 that extends in the array direction and toward the terminal connection surface 11 as a distance from the main body portion 41 increases, has one end portion in the extension direction connected to the other end portion of the first member 421, and has the other end portion in the extension direction serving as the first end portion 44.

With the terminal block 1 according to the fifth aspect, it is possible to display, with a simple configuration, whether the connection state of the conductor portion 100 with respect to the terminal electrode portion 20 is the connected state or the disconnected state through the third opening portion 14.

In the terminal block 1 according to a sixth aspect of the present disclosure, the return spring portion 50 has a metal member.

In the terminal block 1 according to the sixth aspect, since the return spring portion 50 has a metal member, it is possible to reduce deformation, by heat, of the return spring portion 50. As a result, even under the environment where high heat exceeding 100 degrees Celsius is applied, the resiliency required for returning the display-use moveable member 40 can be maintained.

In the terminal block 1 according to a seventh aspect of the present disclosure, the return spring portion 50 is configured by a leaf spring disposed extending in the direction intersecting the terminal connection surface 11.

With the terminal block 1 according to the seventh aspect, it is possible to reduce, with a simple configuration, deformation, by heat, of the return spring portion 50. As a result, even under the environment where high heat exceeding 100 degrees Celsius is applied, the resiliency required for returning the display-use moveable member 40 can be maintained.

In the terminal block 1 of an eighth aspect of the present disclosure, the return spring portion 50 is provided integrally with the contact moveable portion 42 between the first end portion 44 and the second end portion 45 of the contact moveable portion 42 in the array direction, and the one end portion 52 of the return spring portion 50 is bent in the array direction and is disposed inside the contact moveable portion 42.

With the terminal block 1 according to the eighth aspect, it is possible to increase rigidity of the contact moveable portion 42, and it is in turn possible to suppress deformation of the contact moveable portion 42 even when the display-use moveable member 40 is reduced in size. As a result, even when the terminal block 1 is reduced in size, the user can be notified of the accurate connection status of the electric wire.

In the terminal block 1 according to a ninth aspect of the present disclosure, the contact moveable portion 42 has a plate shape and is configured to have a thickness of the first end portion 44 larger than a thickness of the main body portion. 41.

With the terminal block 1 according to the ninth aspect, it is possible to increase rigidity of the contact moveable portion 42, and it is in turn possible to suppress deformation of the contact moveable portion 42 even when the display-use moveable member 40 is reduced in size. As a result, even when the terminal block 1 is reduced in size, the user can be notified of the accurate connection status of the electric wire.

Note that suitably combining any of the various embodiments or any of the various modifications makes it possible to achieve effects possessed by each of the embodiments or the modifications. Further, combinations of the embodiments, combinations of the modifications, or combinations of the embodiments and the modifications are possible, and combinations of features in different embodiments or modifications are also possible.

While the present disclosure has been fully described in connection with the preferred embodiments with reference to the accompanying drawings, it will be apparent to those skilled in the art that various changes and modifications may be made. Unless such changes and modifications depart from the scope of the present disclosure as set forth in the accompanying claims, the changes and modifications should be construed as being included within the scope of the present disclosure.

INDUSTRIAL APPLICABILITY

The terminal block according to the present disclosure is applicable to, for example, a control panel.

REFERENCE SIGNS LIST

1. terminal block
2. housing
3. terminal connection portion
10. holding portion
11. terminal connection surface
12. first opening portion
13. second opening portion
14. third opening portion
15. opening surface
16. guide surface
17. leaf spring fixing portion
18. gap
19. locking portion
20. terminal electrode portion
21. vertical plate portion
22. horizontal plate portion
23. contact portion
30. leaf spring portion
31. fixed portion
32. moveable portion
321. distal end portion
40. display-use moveable member
41. main body portion
42. contact moveable portion
421. first member
422. second member
423. abutting portion
424. third member
425. contact surface
426. curved surface
427. groove portion
43. distal end portion
44. first end portion
45. second end portion
46. protrusion portion
461. distal end portion
50. return spring portion
51. distal end portion
511. one end
52. proximal end portion
521. other end
53. resin spring
54. leaf spring
61. electric wire passage portion
62. jig passage portion
63. moveable member passage portion
64. curved portion
71. first movement restriction portion
72. second movement restriction portion
73. third movement restriction portion
74. fourth movement restriction portion
100. conductor portion
L. imaginary straight line
W. width direction
A. first direction
B. second direction

The invention claimed is:

1. A terminal block comprising:

a housing having insulation properties, the housing comprising:

a holding portion provided in the housing and a terminal connection surface;

a first opening portion through which a conductor portion of an electric wire can be inserted and pulled out;

a second opening portion that is adjacent to the first opening portion and through which a jig can be inserted and pulled out; and a third opening portion that is adjacent to the second opening portion and through which a connection state of the conductor portion can be displayed, wherein the first opening portion, the second opening portion, and the third opening portion are arranged in series on the terminal connection surface and each communicate with the holding portion; and a terminal electrode portion, a leaf spring portion, a display-use moveable member, and a return spring portion that are disposed in the holding portion, wherein:

the holding portion comprises:

an electric wire passage portion that extends in a direction intersecting the terminal connection surface, communicates with the first opening portion, and through which the conductor portion of the electric wire can move;

a jig passage portion that extends in the direction intersecting the terminal connection surface, communicates with the second opening portion, and through which the jig can move;

a guide surface that extends in an array direction of the first opening portion, the second opening portion, and the third opening portion and is disposed so as to cause the electric wire passage portion and the jig passage portion to be interposed between the guide surface and the terminal connection surface in the direction intersecting the terminal connection surface; and a moveable member passage portion that extends in the direction intersecting the terminal connection surface, communicates with the third opening portion, is disposed between the terminal connection surface and the guide surface in the direction intersecting the terminal connection surface, is disposed so as to cause the third opening portion to be located between the moveable member passage portion and the second opening portion, and through which the main body portion of the display-use moveable member can move, the moveable member passage portion comprising a curved portion provided at an end portion adjacent to the third opening portion and curved in the second direction toward the second opening portion, and the distal end portion of the main body portion of the display-use moveable member is curved along the curved shape of the curved portion;

the terminal electrode portion comprises:

a contact portion that extends along the electric wire passage portion and is disposed so as to come into contact with the conductor portion inserted through the first opening portion into the electric wire passage portion;

the leaf spring portion comprises:

a fixed portion that is provided at one end portion of the leaf spring portion and is fixed to the housing to cause the electric wire passage portion and the jig passage portion to be located between the fixed portion and the contact portion of the terminal electrode portion in the array direction; and a moveable portion that is provided at the other end of the leaf spring portion and is disposed between the fixed portion and the terminal electrode portion in the array direction, the moveable portion facing the contact portion of the terminal electrode portion, extending over the electric wire passage portion and the jig passage portion, and being moveable relative to the fixed portion;

the moveable portion is disposed so as to cause the conductor portion inserted through the first opening portion into the electric wire passage portion to be held between the moveable portion and the contact portion of the terminal electrode portion to bring the conductor portion and the terminal electrode portion into a connected state and to come into contact with the jig inserted through the second opening portion into the jig passage portion to release the contact between the moveable portion and the conductor portion to bring the conductor portion and the terminal electrode portion into a disconnected state;

the display-use moveable member comprises:

a main body portion that extends in the direction intersecting the terminal connection surface and can reciprocate between a display position where a distal end portion is exposed outside the housing through the third opening portion and a non-display position where the distal end portion is held in the holding portion; and a contact moveable portion that extends along the guide surface, comprises a first end portion that is disposed so as to come into contact with the conductor portion in the electric wire passage portion and move in a first direction intersecting the terminal connection surface and away from the terminal connection surface, and comprises a second end portion that is connected to the main body portion, and moves in the array direction in response to movement of the first end portion in the first direction to move the main body portion in a second direction intersecting the terminal connection surface and toward the terminal connection surface;

the return spring portion is configured to push the main body portion of the display-use moveable member in the first direction;

in response to the conductor portion being inserted through the first opening portion into the electric wire passage portion to move the first end portion of the contact moveable portion in the first direction, the main body portion moves in the second direction, and the distal end portion of the main body portion adjacent to the terminal connection surface moves from the non-display position to the display position to display a state where the connection state of the conductor portion with respect to the terminal electrode portion is changed from the disconnected state to the connected state; and in response to the conductor portion being pulled out from the electric wire passage portion to move the main body portion in the first direction by pushing force of the return spring portion, the distal end portion moves from the display position to the non-display position to display a state where the connection state of the conductor portion with respect to the terminal electrode portion is changed from the connected state to the disconnected state.

2. The terminal block according to claim 1, wherein the display-use moveable member and the return spring portion are provided integrally.

3. The terminal block according to claim 1, wherein the contact moveable portion of the display-use moveable member comprises:

a first member that extends along the guide surface, comprises one end portion serving as the second end portion, and comprises an abutting portion that slides on the guide surface in response to the movement of the first end portion in the first direction and the second direction, and a second member that extends in the array direction and toward the terminal connection surface as a distance from the main body portion increases, has one end portion connected to the other end portion of the first member, and has the other end portion serving as the first end portion.

4. The terminal block according to claim 1, wherein the return spring portion comprises a metal member.

5. The terminal block according to claim 4, wherein the return spring portion is configured by a leaf spring disposed extending in the direction intersecting the terminal connection surface.

6. The terminal block according to claim 5, wherein the return spring portion is provided integrally with the contact moveable portion between the first end portion and the second end portion of the contact moveable portion in the array direction, and the one end portion of the return spring portion is bent in the array direction and is disposed inside the contact moveable portion.

7. The terminal block according to claim 4, wherein the contact moveable portion has a plate shape and is configured to have a thickness of the first end portion larger than a thickness of the main body portion.

* * * * *